US005212521A

United States Patent [19]

Ogawa et al.

[11] Patent Number: 5,212,521

[45] Date of Patent: May 18, 1993

[54] DEVELOPING UNIT HOUSING WITH TONER SEALS FOR IMAGE RECORDING APPARATUS

[75] Inventors: Moriaki Ogawa, Yokohama; Tetsuo Yamanaka, Kawasaki, both of Japan

[73] Assignee: Ricoh Company, Ltd., Tokyo, Japan

[21] Appl. No.: 828,786

[22] Filed: Jan. 30, 1992

[30] Foreign Application Priority Data

Feb. 6, 1991 [JP] Japan ..... 3-15276

[51] Int. Cl.[5] ..... G03G 15/08

[52] U.S. Cl. ..... 355/215; 118/653; 355/259

[58] Field of Search ..... 355/215, 245, 259; 118/653

[56] References Cited

U.S. PATENT DOCUMENTS

| | | | |
|---|---|---|---|
| 5,035,198 | 6/1991 | Niito | 118/653 |
| 5,057,868 | 10/1991 | Sekino et al. | 355/215 |
| 5,073,797 | 12/1991 | Ono et al. | 355/215 |

FOREIGN PATENT DOCUMENTS

| | | | |
|---|---|---|---|
| 61-129664 | 6/1986 | Japan | 355/215 |
| 61-185770 | 8/1986 | Japan | 355/245 |
| 62-192770 | 8/1987 | Japan | 355/215 |
| 62-208073 | 9/1987 | Japan | 355/215 |

*Primary Examiner*—Joan H. Pendegrass
*Attorney, Agent, or Firm*—Cooper & Dunham

[57] ABSTRACT

A developing unit includes a housing frame containing toner and having an opening; a developing roller rotatably mounted on the housing frame so as to face the opening of the housing frame; a thin blade which is in contact with a surface of the developing roller and scrapes off the toner adhered to the surface of the developing roller so that a thin toner layer is formed on the surface of the developing roller, the toner being supplied from the thin toner layer to a photosensitive belt: and a sealing sheet for sealing a continuous gap formed of a first gap between each end of the developing roller and the housing frame and a second gap between each end of the thin blade and the housing frame, the sealing sheet being divided into a first sealing sheet for sealing the first gap and a second sealing sheet for sealing the second gap.

15 Claims, 7 Drawing Sheets

DEVELOPING UNIT HOUSING WITH TONER SEALS FOR IMAGE RECORDING APPARATUS

BACKGROUND OF THE INVENTION (1) Field of the invention

The present invention generally relates to a developing unit and an image recording apparatus using such, and more particularly to a developing unit and an image recording apparatus using such, in which developing unit a thin developer layer is formed by a thin blade on a surface of a developing roller rotated and in contact with an image carrying medium. The developer is supplied from the thin developer layer to the image carrying medium, so that a developing process is carried out.

(2) Description of related art

A developing unit used in an electrophotographic recording unit, such as a laser beam printer, a copy machine and the like, contains developer such as toner. When the developing unit is operated, a pressure is generated in a housing of the developing unit by operations of an agitator for agitating the toner, a toner supplying mechanism for supplying the toner to a developing roller and the like. In a case where there are various gaps formed on the housing of the developing unit, toner can be spouted by the pressure from the housing via the gaps when the developing unit is operated.

In addition, when the developing unit is replaced, the toner can fall from the housing via the gaps formed in the housing.

In the developing unit, a housing frame 10, a developing roller 11, a thin blade 12, and an elastic sheet 13 are arranged, for example, as shown in FIG. 1. FIG. 1 shows a cross section of an end part of an example of the developing unit. The developing roller 11 is mounted on the housing frame 10 of the developing unit so as to cover an opening (not shown) formed on the housing. The developing roller 11 is rotated in a direction from the thin blade 12 side to the elastic sheet 13 side of the developing unit. The toner in the housing of the developing unit is adhered to the surface of the developing roller 11 via the opening. The thin blade 12 scatters the toner adhered to the surface of the rotated developing roller 11 so that a thin toner layer is formed on the surface of the developing roller 11. The toner is supplied from the thin toner layer formed on the surface of the developing roller 11 to an image carrying medium, such as a photosensitive belt, so that a developing process is carried out.

A gap between the surface of the rotated developing roller 11 and the housing frame 10 is sealed by the thin blade 12 on a upstream side of a developing point at which the toner is supplied from the developing roller 11 to the photosensitive member (the image carrying medium), and sealed by the elastic sheet 13 on a downstream side of the developing area.

Since the developing roller must be rotated, ends of the developing roller 11 cannot be fixed on the housing frame 10. In addition, since the thin blade 12 must be elastically operated, ends of the thin blade 12 can not be fixed on the housing frame 10. Thus, a gap G1 is formed between each end of the developing roller 11 and the housing frame 10 of the developing unit, and a gap G2 is formed between each end of the thin blade 12 and the housing frame 10. These gaps G1 and G2 (indicated by oblique lines in FIG.1) should be sealed to prevent the toner from dispersing through them. As the gaps G1 and G2 form a continuous gap, the two gaps G1 and G2 are conventionally sealed by one sealing member.

However, in a case where the two gaps G1 and G2 are sealed by one sealing member, it is hard for the toner to be completely prevented from dispersing. An optimum sealing member for definitely sealing a gap between a rotated structure and a fixed structure differs from that for definitely sealing a gap between fixed structures. That is, when the sealing member is formed so as to favorably seal the gap G1 between the rotated developing roller 11 and the fixed housing frame 10, it is hard for the same sealing member to definitely seal the gap G2 between the fixed thin blade 12 and the fixed housing frame 10, and vice versa.

Further, a small gap C is formed between the surface of the developing roller 11 and an end part of the thin blade 12 due to the rotation of the developing roller 11, as shown in FIG. 1B. The small gap C extends in a direction approximately parallel to an axis of the developing roller 11. In this case, the toner will leak through the small gap C.

In addition, each end 13*a* of the elastic sheet 13 is in steady contact with the surface of the housing frame 10, so that the toner is prevented from dispersing through a gap between the end 13*a* of the elastic sheet 13 and the housing frame 10.

However, it is difficult to form the elastic sheet having a constant length. Thus, in a case where the elastic sheet 13 is formed so that the length thereof is slightly shorter than the constant length, the edge 13*a* of the elastic sheet 13 can not be in steady contact with the housing frame 10 of the developing unit. In this case, the toner will leak between the edge 13*a* of the elastic sheet 13 and the housing frame 10. Japanese Patent Laid Open Publication No.62-208073 discloses a sealing member for sealing a gap between the end of the elastic sheet and an end part of the housing frame. However, it is hard for the sealing member to securely seal the gap between the end of the elastic sheet and the housing frame.

SUMMARY OF THE INVENTION

Accordingly, a general object of the present invention is to provide a novel and useful developing unit and a recording apparatus using such in which the disadvantages of the aforementioned prior art are eliminated.

A more specific object of the present invention is to provide a developing unit in which developer can be definitively prevented from scattering from a housing of the developing unit.

The above objects of the present invention are achieved by a developing unit for supplying developer to a surface of an image carrying medium on which a latent image is formed, so that the latent image is visualized by the developer, the developing unit comprising: a housing frame containing developer and having an opening; a developing roller rotatably mounted on the housing frame so as to face the opening of the housing frame, the developer in the housing frame being supplied to the developing roller via the opening; a blade having a width approximately equal to a length of the developing roller, the blade being in contact with a surface of the developing roller and scraping off the developer adhered to the surface of the developing roller so that a thin developer layer is formed on the surface of the developing roller, the developer being supplied from the thin developer layer to the image carrying medium; and a sealing member for sealing a continuous gap formed of a first gap between each end of the developing roller and the housing frame and a second gap between each end of the blade and the housing frame, the sealing member being divided into a first sealing member for sealing the first gap and a second sealing member for sealing the second gap.

According to the present invention, as the sealing member is divided into the first sealing member and the second sealing member, the first and second sealing member can be respectively formed of optimum materials for sealing the first and second gaps. Thus, developer can be securely prevented from scattering from a housing of the developing unit.

The above objects of the present invention are also achieved by a developing unit for supplying developer to a surface of an image carrying medium on which a latent image is formed, so that the latent image is visualized by the developer, the developing unit comprising: a housing frame containing developer and having an opening; a developing roller rotatably mounted on the housing frame so as to face the opening of the housing frame, the developer in the housing frame being supplied to the developing roller via the opening; a blade having a width approximately equal to a length of the developing roller, the blade being in contact with a surface of the developing roller and scraping from the developer adhered to the surface of the developing roller so that a thin developer layer is formed on the surface of the developing roller, the developer being supplied from the thin developer layer to the image carrying medium; an end sealing member for sealing a continuous gap formed of a first gap between each end of the developing roller and the housing frame and a second gap between each end of the blade and the housing frame; and a sealing member for sealing a gap between the developing roller and the housing frame, which gap extends in a direction parallel to an axis of rotation of of the developing roller, and the sealing member and the end sealing member overlap each other at each end of the developing roller.

According to the present invention, as the sealing member and the end sealing member overlap each other at each end of the developing roller, the developer is securely prevented from scattering through a gap between the end sealing member and the sealing member.

Another object of the present invention is to provide an image recording apparatus in which the inside of a housing can be securely protected from being made dirty by developer scattered from a developing unit.

The objects of the present invention are achieved by an image recording apparatus comprising: an image carrying medium; a writing unit for forming a latent image on the image carrying medium; a developing unit for supplying developer to a surface of an image carrying medium on which a latent image is formed, so that the latent image is visualized by the developer; and a recording unit for recording a visualized image obtained by the developing unit on a recording medium; wherein the developing unit comprises: a housing frame containing developer and having an opening; a developing roller rotatably mounted on the housing frame so as to face the opening of the housing frame, the developer in the housing frame being supplied to the developing roller via the opening; a blade having a width approximately equal to a length of the developing roller, the blade being in contact with a surface of the developing roller and scraping off the developer adhered to the surface of the developing roller so that a thin developer layer is formed on the surface of the developing roller, the developer being supplied from the thin developer layer to the image carrying medium; and a sealing member for sealing a continuous gap formed of a first gap between each end of the developing roller and the housing frame and a second gap between each end of the blade and the housing frame, the sealing member being divided into a first sealing member for sealing the first gap and a second sealing member for sealing the second gap.

The above objects are also achieved by an image recording apparatus comprising: an image carrying medium; a writing unit for forming a latent image on the image carrying medium;

a developing unit for supplying developer to a surface of an image carrying medium on which a latent image is formed, so that the latent image is visualized by the developer; and a recording unit for recording a visualized image obtained by the developing unit on a recording medium; wherein the developing unit comprises: a housing frame containing developer and having an opening; a developing roller rotatably mounted on the housing frame so as to face the opening of the housing frame, the developer in the housing frame being supplied to the developing roller via the opening; a blade having a width approximately equal to a length of the developing roller, the blade being in contact with a surface of the developing roller and scraping from the developer adhered to the surface of the developing roller so that a thin developer layer is formed on the surface of the developing roller, the developer being supplied from the thin developer layer to the image carrying medium; an end sealing member for sealing a continuous gap formed of a first gap between each end of the developing roller and the housing frame and a second gap between each end of the blade and the housing frame; and a sealing member for sealing a gap between the developing roller and the housing frame, which gap extends in a direction parallel to an axis of rotation of the developing roller, and the sealing member and the end sealing member overlapping with each other at each end of the developing roller.

According to the present invention, as the developer is securely prevented from scattering from the housing of the developing unit, the inside of a housing of the developing unit can be securely protected from being made dirty by developer scattered from a developing unit.

Additional objects, features and advantages of the present invention will become apparent from the following detailed description when read in conjunction with the accompanying drawings.

DESCRIPTION OF THE PREFERRED EMBODIMENTS

A description will now be given of an embodiment of the present invention.

Figure 1A:
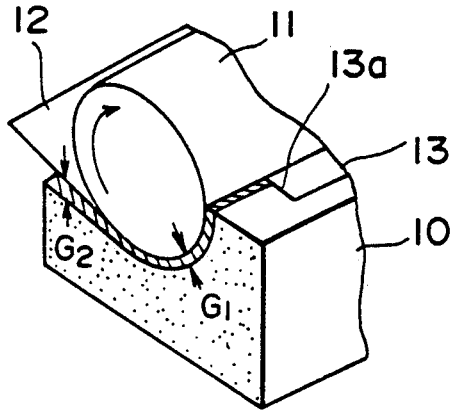
FIG. 1A (PRIOR ART)
FIG. 1A is a diagram illustrating a cross section of an end of a conventional developing unit having a developing roller.
Figure 1B:
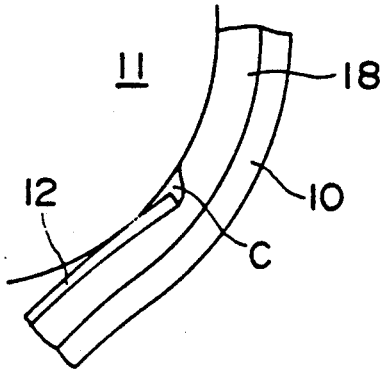
FIG. 1B (PRIOR ART)
FIG. 1B is a enlarged cross sectional view of an end the conventional developing unit.
Figure 2:
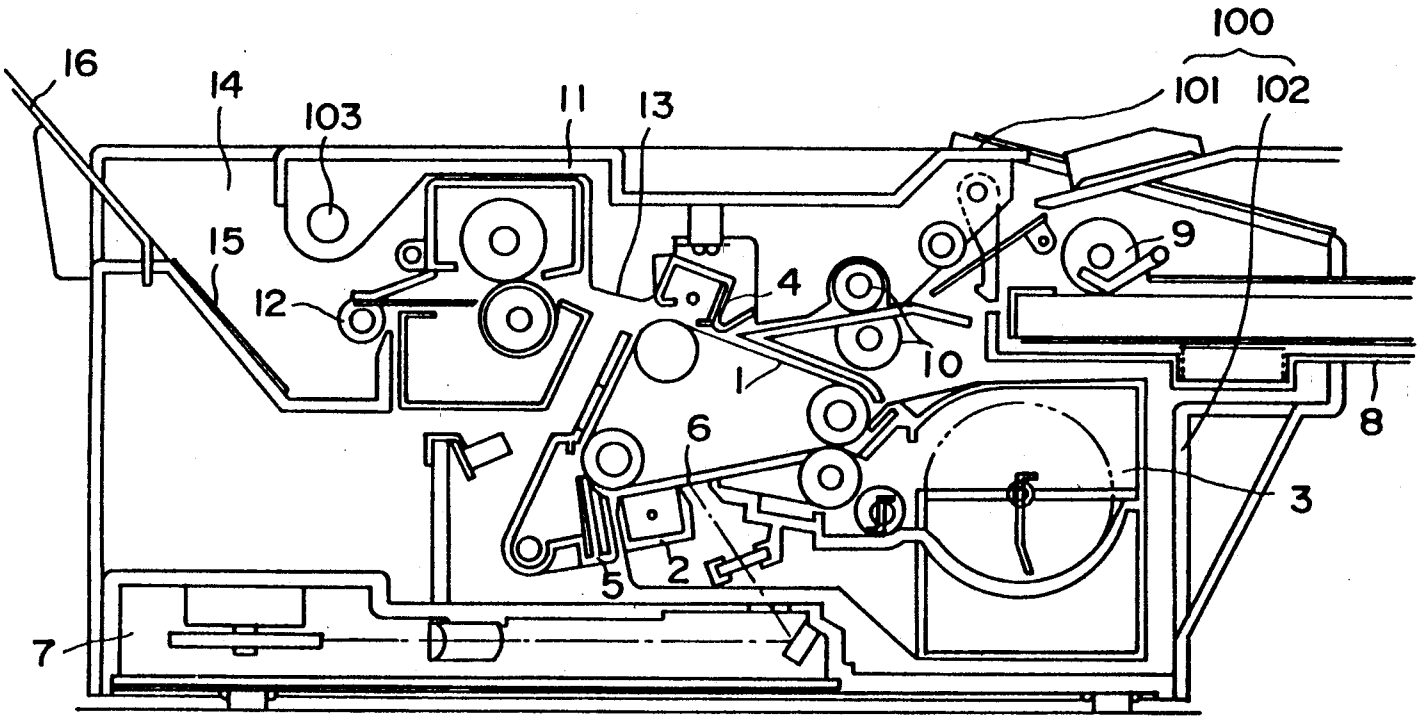
FIG. 2 is a cross sectional view of a recording apparatus according to an embodiment of the present invention.

Referring to FIG. 2, which shows a laser printer, a housing 100 of the laser printer is divided into an upper frame 101 and a lower frame 102. The upper frame 102 can be rotated around a shaft 103 so that the housing 100 can be opened. A photosensitive belt 1 (the image carrying medium) is mounted in the housing 100. The photosensitive belt 1 is wound around rollers so as to be rotated in a predetermined direction. A precharger unit 2, a developing unit 3, a transfer charger unit 4, and a cleaning unit 4 are arranged around the photosensitive belt 1 in this order, in the same direction as that in which the photosensitive belt 1 is rotated. An optical writing unit 7 is mounted on a base plate of the housing 100 so that a light beam emitted from the optical writing unit 7 scans a part of the photosensitive belt 1 positioned between the precharger unit 2 and the developing unit 3. When the light beam emitted from the optical writing unit 7 scans the photosensitive belt 1 which has been uniformly precharged by the precharger unit 2, an electrostatic latent image is formed on the surface of the photosensitive belt 1. Then the developing unit 3 supplies the toner to the photosensitive belt 1 so that a toner image corresponding to the electrostatic latent image is formed. That is, the developing unit 3 develops the electrostatic latent image, so that a visible image is obtained.

A recording paper is fed one by one by a supply roller 9 from a paper cassette 8. The recording paper is then fed by a registration rollers 10 toward the transfer charger unit 4 at a predetermined timing so that the toner image formed on the photosensitive belt 1 faces the recording paper at a position where the transfer charger unit 4 is mounted. When the recording paper passes between the photosensitive belt 1 and the transfer charger unit 4, the toner image is transferred by the transfer charger unit 4 from the photosensitive belt 1 to the recording paper. After this, the recording paper is separated from the photosensitive belt 1 and fed to a fusing unit 11 via a guide plate 13. The toner image on the recording paper is fused and fixed by the fusing unit 11 After passing through the fusing unit 11 the recording paper is guided by an ejection guide plate 15 and ejected to a tray 16.

Figure 3:
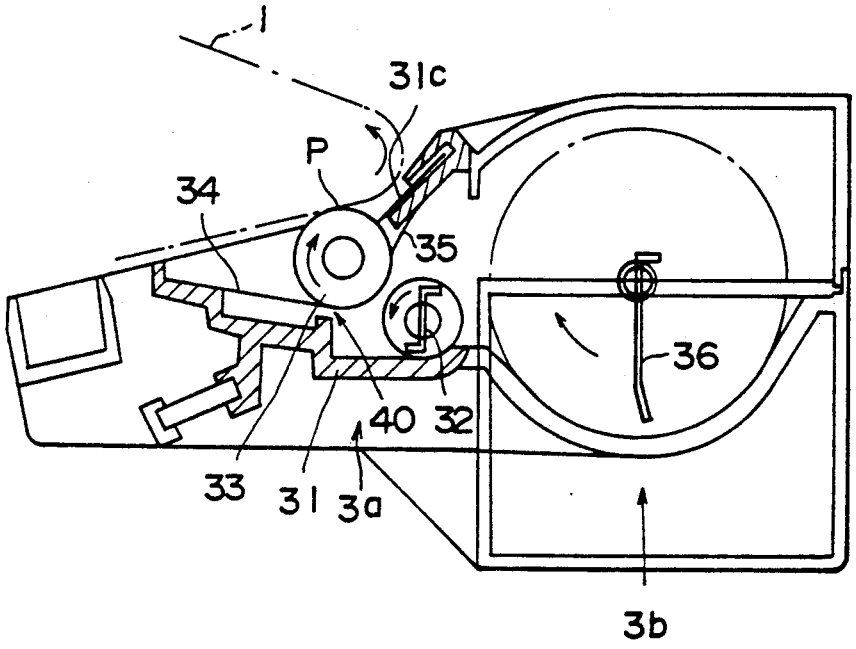
FIG. 3 is a cross sectional view of a developing unit mounted in the recording apparatus shown in FIG. 2.

The developing unit 3 is formed as shown, for example, in FIG. 3.

Referring to FIG. 3, the developing unit 2 has a developing part 3*a* and a storage part 3*b*. Toner is stored in the storage part 3*b* provided with an agitator 36. The agitator 36 is rotated at a predetermined speed so as to agitate the toner in the storage part 3*b*. When the agitator 36 agitates the toner in the storage part 3*b*, the toner moves from the storage part 3*b* to the developing part 3*a*. The developing part 3*a* has a frame 31 on which an opening 40 is formed so as to face the photosensitive belt 1. A supplying mechanism 32 and a developing roller 33 are provided in the developing part 3*a*. The supplying mechanism 32 is positioned near the storage part 3*b* and supplies the toner to the surface of the the developing roller 33. The developing roller 33 covers the opening 40 and is in contact with the surface of the photosensitive belt 1 at a developing point P. A thin blade 34 is mounted on the frame 31 at a predetermined position in the perimeter of the opening 40 so that an end of the thin blade 34 is in contact with the surface of the developing roller 33. The toner supplied by the supplying mechanism 32 is adhered to the surface of the developing roller 33. The toner adhered to the surface of the developing roller 33 is then scraped by the thin blade 34, so that a thin toner layer is formed on the surface of the developing roller 33. As the thin toner layer is formed on the surface of the developing roller 33 between a point at which the thin blade is in contact with the surface of the developing roller 33 and the developing point P, a constant amount of toner is supplied from the developing roller 33 to the photosensitive belt 1 at the developing point P in a developing process. The thin blade 34 seals a gap between the developing roller 33 and the frame 31 on the upstream side of the developing point P. An elastic sheet 35 is mounted on an edge part 31*c* of the opening 40 positioned on a downstream side of the point P. An end of the elastic sheet 35 is in contact with the surface of the developing roller 33. The elastic sheet 35 seals a gap between the developing roller and the frame 31 on the downstream side of the developing point P. Due to the thin blade 34 and the elastic sheet 35, the toner is prevented from being spouted from the developing part 3*a* of the housing of the developing unit 3 via the gap between the surface of the developing roller 33 and the frame 31.

Figure 4:
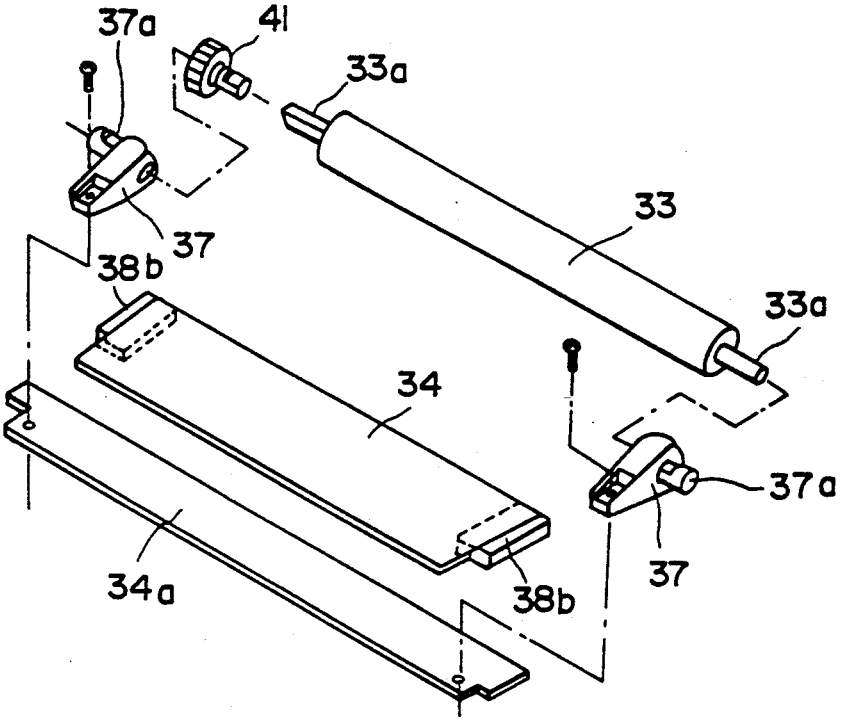
FIG. 4 is an exploded perspective view illustrating an assembly of a developing roller and a thin blade.

The developing roller 33 and the thin blade 34 are assembled as shown in FIG. 4.

Referring to FIG. 4, the thin blade 34 is adhered to a holder plate 34*a* by an adhesive. A blade sealing member 38*b* is adhered to each end part of the thin blade 34 so as to cover each end part of the thin blade 34. A bearing 37 is fixed at each end of the holder plate 34*a* by a screw. The bearing 37 is rotatably engaged with a shaft 33*a* of the developing roller 33 so that the holder plate 34*a* can be rotated in directions A and B shown in FIG. 5A around the shaft 33*a* with the thin blade 34. A gear 41 used for driving the developing roller 33 is mounted on an end of the developing roller 33.

Figure 5A:
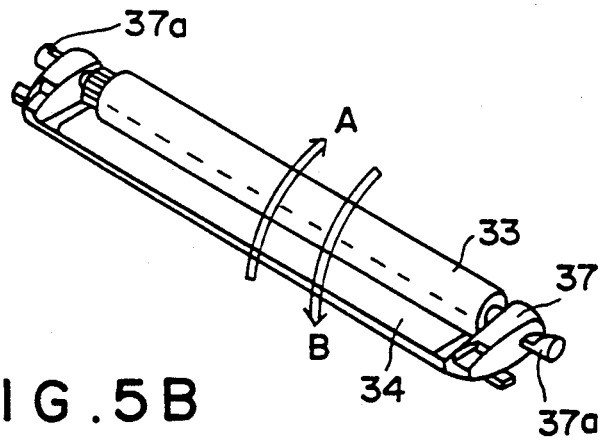
FIGS. 5A and 5B are perspective views illustrating the assembly of a developing roller and a thin blade.
Figure 5B:
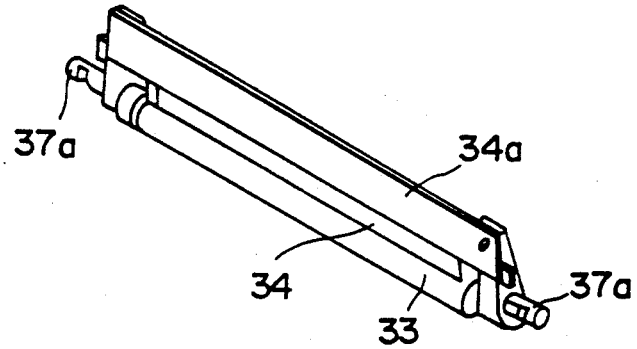
Figure 6:
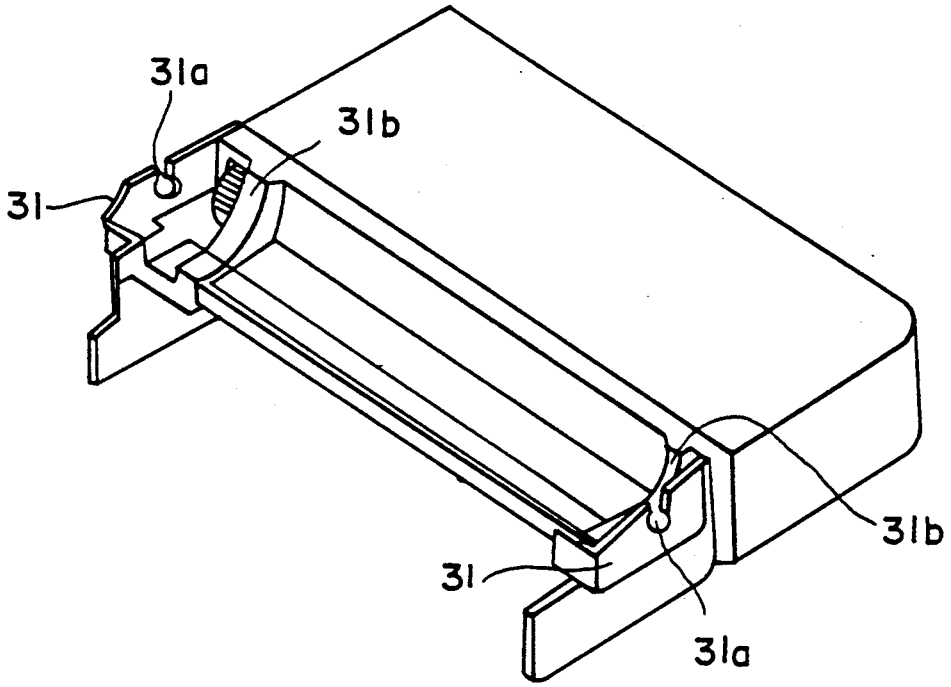
FIG. 6 is a perspective view illustrating a structure of a housing frame of the developing unit.

The developing roller 33 and the thin blade 34 are assembled as described above, so that a developing roller assembly is formed as shown in FIG. 5A. Shafts 37*a* projecting from the bearings 37 are inserted, previously, into supporting pits 31*a* formed on both ends of the frame 31 of the developing unit, shown in FIG. 6, under a condition in which the thin blade 34 is rotated in a direction B so as to stand as shown in FIG. 5B, and then the thin blade 34 is rotated in a direction A so as to return to an original position, so that the developing roller assembly is mounted on the frame 31.

A housing frame of the developing unit has sealing parts 31*b* corresponding to both ends of the developing roller assembly. Before the developing roller assembly is mounted on the frame 31, a roller sealing sheet 38*a* is adhered to each of the sealing parts 31*b*. As a result, in a state where the developing roller assembly is mounted on the frame 31, the gap G1 between the surface of each of the sealing parts 31*b* and the surface of each end of the developing roller 33 is sealed by the roller sealing sheet 38*a*. In this case additionally, the gap G2 between the surface of each of the sealing parts 31*a* and the surface of each end of the thin blade 34 is sealed by the corresponding blade sealing sheet 38*b* adhered to each end of the thin blade 34.

Figure 7:
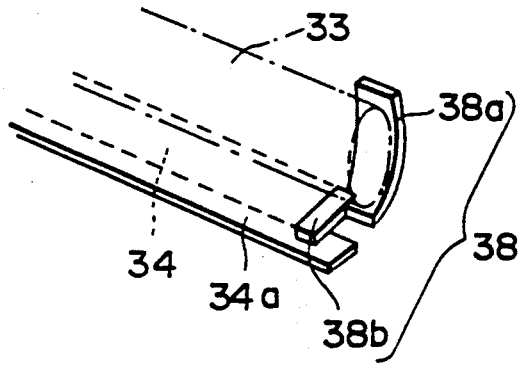
FIG. 7 is a diagram illustrating arrangement of a roller sealing sheet and a blade sealing sheet.

The roller sealing sheet 38*a* and the blade sealing sheet 38*b* are steadily in contact with each other on each of the sealing parts 31*b*, as shown in FIG. 7. That is, the gaps G1 and G2, forming a continuous gap between the sealing parts 31*b* and the developing roller assembly, are sealed by the roller sealing sheet 38*a* and the blade sealing sheet 38*b*. A state where the roller sealing sheet 38*a* and the blade sealing sheet 38*b* are in contact with each other is shown, in detail, in FIG. 8. That is, the roller sealing sheet 38*a* has a notch 38*a*-2 at a corner thereof, and a corner of the blade sealing sheet 38*b* is engaged with the notch 38*a*-2 of the roller sealing sheet 38*a*. That is, the notch 38*a*-2 surrounds the corner of the blade sealing sheet 38*b* so that a corner part 38*a*-1 adjacent to the notch 38*a*-2 covers a side end of the blade sealing sheet 38*b*.

As the roller sealing sheet 38*a* must seal the gap between the rotated developing roller 33 and the housing frame, the roller sealing sheet 38*a* is formed of a material having a relatively small friction coefficient and a relatively large abrasion resistance, such as a felt sheet of Teflon (registered trade mark), a brush or the like. As the blade sealing sheet 38*b* seals the gap between the fixed thin blade 34 and the fixed housing frame, the blade sealing sheet 38*b* is formed, for example, of a foam polyurethane resin. The roller sealing sheet 38*a* and the blade sealing sheet 38*b* are formed of materials selected based on conditions of the gaps. Thus, both the gap G1 between the rotated developing roller 33 and the housing frame and the gap G2 between the fixed thin blade 24 and the housing frame can be securely sealed by the roller sealing sheet 38*a* and the blade sealing sheet 38*b*.

Figure 8:
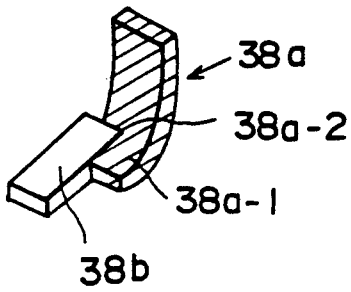
FIG. 8 is a diagram illustrating the roller sealing sheet and the blade sealing sheet which are in contact with each other.
Figure 9:
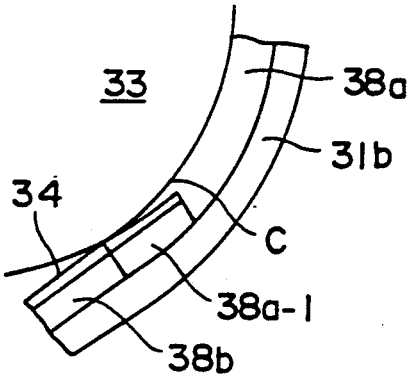
FIG. 9 is a diagram illustrating a state where a corner portion of the roller sealing sheet covers a small gap formed between the developing roller and the thin blade.

In addition, as the corner part 38*a*-1 of the roller sealing sheet 38*a* covers the side end of the blade sealing member 38*b* as shown in FIG. 8, even if a small gap C is formed between the surface of the developing roller 33 and the thin blade 34 due to the rotation of the developing roller 33, the gap C is covered by the corner part 38*a*-1 of the roller sealing sheet 38*b*, as shown in FIG. 9. Thus, the toner is prevented from being spouted through the gap C in a direction parallel to the axis of the developing roller 33.

A description will now be given, with reference to FIGS. 10 and 11, of an example of the elastic sheet 35 for sealing the gap between the developing roller 33 and the housing frame of the developing unit.

Figure 10:
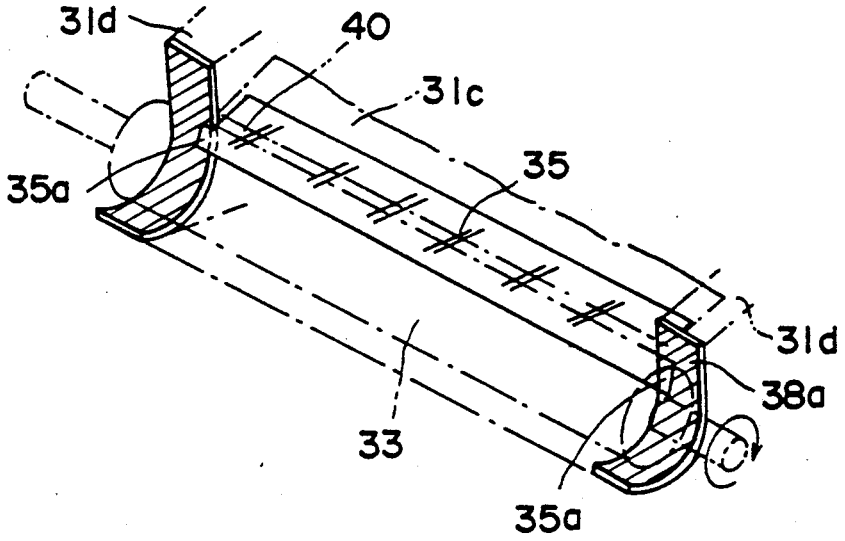
FIGS. 10 and 11 are diagrams illustrating an elastic sheet for sealing a gap between the developing roller and the housing roller, which gap extends in a direction parallel to an axis of the developing roller.
Figure 11:
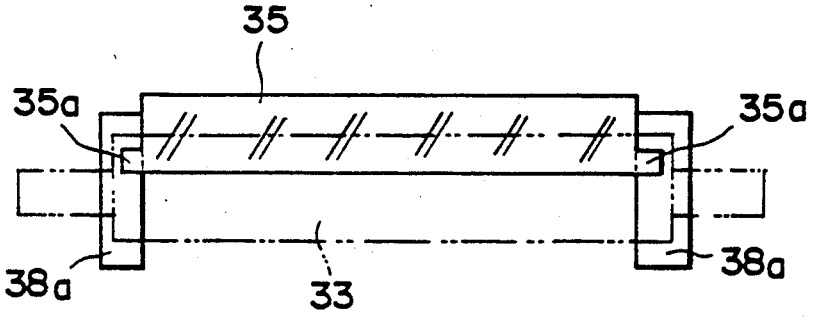

Referring to FIGS. 10 and 11, the end part 31*c* adjacent to the opening 40 is formed between projection walls 31*d* projecting from the housing frame. The sealing part 31*b* described above is formed on each of the projection walls 31*d*. A back end part of the elastic sheet 35 is adhered to the end part 31*c* so that the elastic sheet 35 projects from the end part 31*c*. The width of the back end part of the elastic sheet 35 is approximately the same as the distance between the projection walls 31*d*. A front end part of the elastic sheet 35 has extension parts 35*a* extending in a direction parallel to the width of the elastic sheet 35. Each of the extension parts 35*a* of the elastic sheet 35, and the roller sealing sheets 38*a* adhered to the projection walls 31*d* overlap. In this state, when the developing roller assembly is mounted on the frame 31, the front end part of the elastic sheet 35 is brought into contact with the surface of the developing roller 33.

The elastic sheet 35 is formed, for example, of polyester film (PETP) having thickness within a rage of 0.05–0.125 mm. The front part of the elastic sheet 35 is weekly pressed against the surface of the developing roller 33 so that residual toner adhered to the developing roller 3 is not scraped off by the elastic sheet 35. That is, the residual toner adhered to the developing roller 33 returns to the inside of the housing frame via the elastic sheet 35.

In the above case, even if the width of the elastic sheet 35 varies, a state where extension parts 35*a* of the elastic sheet 35 and the roller sealing sheet 38*a* overlap is maintained. Thus, even if the width of the elastic sheet 35 is roughly controlled in the production process, there is no case where a gap is formed between the elastic sheet 35 and the roller sealing sheets 38*a* adhered to each of projection walls 31*d*. That is, the required cost for producing the elastic sheet 35 can be decreased. In addition, the toner is definitely prevented from being spouted from a gap between the elastic sheet 35 and the roller sealing sheet 38*a*.

When the width of the back end part of the elastic sheet 35 is slightly less than the distance between the projection walls 31*d*, a gap between each end of the elastic sheet 35 and a corresponding one of the projection walls 31*d* can be easily sealed since the projection walls 31*d* and the elastic sheet 35 are not moved, like the developing roller 33.

The present invention is not limited to the aforementioned embodiments, and variations and modifications may be made without departing from the scope of the claimed invention.

What is claimed is:

1. A developing unit for supplying developer to a surface of an image carrying medium on which a latent image is formed, so that the latent image is visualized by the developer, said developing unit comprising:

a housing frame containing developer and having an opening;

a developing roller rotatably mounted on said housing frame so as to face the opening of said housing frame, the developer in the housing frame being supplied to the developing roller via the opening;

a blade having a width approximately equal to a length of said developing roller, said blade being in contact with a surface of said developing roller and scraping off the developer adhered to the surface of said developing roller so that a thin developer layer is formed on the surface of said developing roller, the developer being supplied from the thin developer layer to said image carrying medium; and a sealing member for sealing a continuous gap formed of a first gap between each end of said developing roller and said housing frame and a second gap between each end of said blade and said housing frame, said sealing member being divided into a first sealing member for sealing the first gap and a second sealing member for sealing the second gap, wherein said first sealing member has a notch formed at a corner thereof, and wherein a corner of said second sealing member is engaged with the notch of said first sealing member so that a corner, of said first sealing member, adjacent to the notch covers a side end of said second sealing member.

2. A developing unit as claimed in claim 1, wherein said first sealing member is fixed on a part of said housing frame, said part facing the end of said developing roller, and wherein said second sealing member is fixed on an end of said blade.

3. A developing unit as claimed in claim 1, wherein said first sealing member is formed of a material having a relatively small friction coefficient.

4. A developing unit as claimed in claim 3, wherein said material has a relatively large abrasion resistance.

5. A developing unit as claimed in claim 1, wherein said second sealing member is formed of a foamed resin.

6. A developing unit for supplying developer to a surface of an image carrying medium on which a latent image is formed, so that the latent image is visualized by the developer, said developing unit comprising:

a housing frame containing developer and having an opening;

a developing roller rotatably mounted on said housing frame so as to face the opening of said housing frame, the developer in the housing frame being supplied to the developing roller via the opening;

a blade having a width approximately equal to a length of said developing roller, said blade being in contact with a surface of said developing roller and scraping off the developer adhered to the surface of said developing roller so that a thin developer layer is formed on the surface of said developing roller, the developer being supplied from the thin developer layer to said image carrying medium;

an end sealing member for sealing a continuous gap formed of a first gap between each end of said developing roller and said housing frame and a second gap between each end of said blade and said housing frame, wherein said end sealing member is divided into a first end sealing member for sealing the first gap and a second end sealing member for sealing the second gap; and a sealing member for sealing a gap between said developing roller and said housing frame, which gap extends in a direction parallel to an axis of rotation of said developing roller, and said sealing member and said end sealing member overlap each other at each end of said developing roller, wherein said first end sealing member has a notch formed at a corner thereof, and wherein a corner of said second end sealing member is engaged with the notch of said first end sealing member so that a corner of said first end sealing member, adjacent to the notch, covers a side end of said second end sealing member.

7. A developing unit as claimed in claim 6, wherein said first end sealing member is fixed on a part of said housing frame, said part facing the end of said developing roller, and wherein said second end sealing member is fixed on the end of said blade.

8. A developing unit as claimed in claim 6, wherein said first end sealing member is formed of a material having a relatively small friction coefficient.

9. A developing unit as claimed in claim 8, wherein said material has a relatively large abrasion resistance.

10. A developing unit as claimed in claim 6, wherein said second end sealing member is formed of a foamed resin.

11. A developing unit as claimed in claim 6, wherein said sealing member is formed of polyester film.

12. An image recording apparatus comprising: an image carrying medium;

a writing unit for forming a latent image on said image carrying medium;

a developing unit for supplying developer to a surface of an image carrying medium on which a latent image is formed, so that the latent image is visualized by the developer; and a recording unit for recording, on a recording medium, a visualized image obtained by said developing unit;

wherein said developing unit comprises:

a housing frame containing developer and having an opening;

a developing roller rotatably mounted on said housing frame so as to face the opening of said housing frame, the developer in the housing frame being supplied to the developing roller via the opening;

a blade having a width approximately equal to a length of said developing roller, said blade being in contact with a surface of said developing roller and scraping off the developer adhered to the surface of said developing roller so that a thin developer layer is formed on the surface of said developing roller, the developer being supplied from the thin developer layer to said image carrying medium; and a sealing member for sealing a continuous gap formed of a first gap between each end of said developing roller and said housing frame and a second gap between each end of said blade and said housing frame, said sealing member being divided into a first sealing member for sealing the first gap and a second sealing member for sealing the second gap, wherein said first sealing member has a notch formed at a corner thereof, and wherein a corner of said second sealing member is engaged with the notch of said first sealing member so that a corner, of said first sealing member, adjacent to the notch covers a side end of said second sealing member.

13. An image recording apparatus comprising:

an image carrying medium;

a writing unit for forming a latent image on said image carrying medium;

a developing unit for supplying developer to a surface of an image carrying medium on which a latent image is formed, so that the latent image is visualized by the developer; and a recording unit for recording, on a recording medium, a visualized image obtained by said developing unit;

wherein said developing unit comprises:

a housing frame containing developer and having an opening;

a developing roller rotatably mounted on said housing frame so as to face the opening of said housing frame, the developer in the housing frame being supplied to the developing roller via the opening;

a blade having a width approximately equal to a length of said developing roller, said blade being in contact with a surface of said developing roller and scraping off the developer adhered to the surface of said developing roller so that a thin developer layer is formed on the surface of said developing roller, the developer being supplied from the thin developer layer to said image carrying medium;

an end sealing member for sealing a continuous gap formed of a first gap between each end of said developing roller and said housing frame and a second gap between each end of said blade and said housing frame, wherein said end sealing member is divided into a first end sealing member for sealing the first gap and a second end sealing member for sealing the second gap; and a sealing member for sealing a gap between said developing roller and said housing frame, which gap extends in a direction parallel to an axis of rotation of said developing roller, and said sealing member and said end sealing member overlap each other at each end of said developing roller, wherein said first end sealing member has a notch formed at a corner thereof, and wherein a corner of said second end sealing member is engaged with the notch of said first end sealing member so that a corner of said second end sealing member; adjacent to the notch, covers a side end of said second end sealing member.

14. An image recording apparatus as claimed in claim 13, wherein said end sealing member is divided into a first end sealing member for sealing the first gap and a second end sealing member for sealing the second gap.

15. An image recording apparatus as claimed in claim 14, wherein said first end sealing member is fixed on a part of said housing frame, said part facing the end of said developing roller, and wherein said second end sealing member is fixed on the end of said blade.

* * * * *